US009687071B2

(12) United States Patent
Steinebrunner et al.

(10) Patent No.: US 9,687,071 B2
(45) Date of Patent: Jun. 27, 2017

(54) TUFTING TOOL AND BRUSH MAKING MACHINE

(71) Applicant: Zahoransky AG, Todtnau (DE)

(72) Inventors: Robert Steinebrunner, Todtnau (DE); Guido Sommer, Wembach (DE); Christoph Albrecht, Todtnau-Aftersteg (DE); Philipp Goldmann, Wembach (DE)

(73) Assignee: Zahoransky AG, Todtnau (DE)

( * ) Notice: Subject to any disclaimer, the term of this patent is extended or adjusted under 35 U.S.C. 154(b) by 194 days.

(21) Appl. No.: 14/744,226

(22) Filed: Jun. 19, 2015

(65) Prior Publication Data

US 2015/0374116 A1 Dec. 31, 2015

(30) Foreign Application Priority Data

Jun. 26, 2014 (DE) ..... 10 2014 009 277

(51) Int. Cl.

| | |
|---|---|
| ***A46B 3/04*** | (2006.01) |
| ***A46D 3/04*** | (2006.01) |
| ***A46B 3/16*** | (2006.01) |
| ***A46D 3/08*** | (2006.01) |

(52) U.S. Cl.

CPC ..... *A46D 3/04* (2013.01); *A46B 3/16* (2013.01); *A46D 3/042* (2013.01); *A46D 3/08* (2013.01)

(58) Field of Classification Search

CPC ..... A46D 3/04; A46D 3/042; A46D 3/08

USPC ..... 300/5, 7, 8

See application file for complete search history.

(56) References Cited

U.S. PATENT DOCUMENTS 746,943 A * 12/1903 Fisher et al. ..... A46D 3/042 300/8

5,542,749 A * 8/1996 Toth ..... A46D 3/042 300/4

FOREIGN PATENT DOCUMENTS

| | | |
|---|---|---|
| DE | 3935760 | 5/1991 |
| DE | 19600193 | 7/1997 |
| EP | 0289059 | 11/1988 |

* cited by examiner

*Primary Examiner* — Laura C Guidotti

(74) *Attorney, Agent, or Firm* — Volpe and Koenig, P.C.

(57) ABSTRACT

A tufting tool for tufting and fastening clusters of bristles in bristle holes in a contoured surface of or oblique holes in a brush body. The tufting tool has a tool head displaceable along the tufting axis between a receiving and a tufting position. The tool head has two guide jaws which are displaceable relative to each other during displacement of the tool head. To relatively displace the guide jaws, the tool has a reversing lever connected to the tool head and a deflecting guide for the reversing lever, arranged at an angle of deflection with respect to the tufting axis. The guide jaws are coupled together via the reversing lever in such a manner and the reversing lever is guided such that an adjustment of the tool head into the tufting position advances one guide jaw in the tufting direction and retracts the other guide jaw counter to the tufting direction.

20 Claims, 1 Drawing Sheet

TUFTING TOOL AND BRUSH MAKING MACHINE

INCORPORATION BY REFERENCE

The following documents are incorporated herein by reference as if fully set forth: German Patent Application No. 10 2014 009 277.1, filed Jun. 26, 2014.

BACKGROUND

The invention relates to a tufting tool for tufting and fastening clusters of bristles, in particular by the use of anchor plates, in bristle holes which are introduced into a contoured surface of a brush body and/or obliquely into a surface of a brush body, the tufting tool having a slider which is movable in a slider guide along a tufting axis from a receiving position for receiving a cluster of bristles into a tufting position and back again into the receiving position, a pusher tongue which is movable to and fro relative to the slider along the tufting axis of the tufting tool in a pusher channel, and a tool head which is displaceable along the tufting axis between a receiving position and a tufting position and has a pair of guide jaws for the pusher tongue, the guide jaws being displaceable relative to each other during the adjustment of the tool head from the receiving position into the tufting position.

The invention furthermore relates to a brush making machine with such a tufting tool.

Tufting tools of this type and brush making machines with such tufting tools are known in various embodiments.

For example, EP 0289059 B1 discloses a tufting tool, the guide jaws of which are held movably in the longitudinal direction, wherein the guide jaws of said tufting tool are pressed into a front position by a force which acts in the tufting direction. If said guide jaws strike against the brush body to be tufted, said guide jaws are pressed back relative to the tufting axis of the tufting tool by the brush body counter to the force and in a manner corresponding to the inclination of a surface of the brush body.

However, in the case of this previously known tufting tool, damage to the brush body by the guide jaws striking thereagainst is not ruled out.

In DE 39 35 760 C2, the two guide jaws of the tufting tool are coupled to each other via a rotatable part and elongated hole guides such that the one guide jaw moves forward when the other guide jaw is moved back. The relative movement of the guide jaws is also initiated here by the guide jaws striking against the surface of the brush body.

A tufting tool, the guide jaws of which are likewise coupled to each other, is previously known from DE 196 00 193 A1. In order to permit an orientation of the two guide jaws with an inclination of the surface of the brush body to be tufted even before the guide jaws strike against the surface of the brush body, it is proposed in this document even before the striking action to bring the two guide jaws into a corresponding position relative to each other with the aid of a motor and an NC system.

SUMMARY

It is the object of the present invention to provide a tufting tool and a brush making machine of the type mentioned at the beginning which permit the guide jaws of the tufting tool to be oriented in a manner adapted to an oblique position or inclination of a surface of the brush body to be equipped, without contact between the guide jaws and the brush body and without a comparatively complicated NC system and a separate actuator.

In the case of the tufting tool defined at the beginning, this object is achieved by the use of one or more features according to the invention and in particular in that the tufting tool has a reversing lever which is connected to the tool head and a deflecting guide for the reversing lever which deflecting guide is arranged at an angle of deflection with respect to the tufting axis of the tufting tool, and that the two guide jaws are coupled to each other via the reversing lever in such a manner and the reversing lever is guided in the deflecting guide thereof in such a manner that an adjustment of the tool head into the tufting position is connected to an advance of the one guide jaw in the tufting direction and to a retraction of the other guide jaw counter to the tufting direction, with the deflecting guide being adjustable relative to the tufting axis in order to change the angle of deflection between the tufting axis of the tufting tool and the deflecting guide. The two guide jaws are thereby oriented in a desired manner so as to correspond to the orientation of the brush body to be tufted or the surface thereof even as the tool head advances. The orientation of the two guide jaws can be adapted here in a desired manner to different orientations of surfaces and/or bristle holes of brush bodies to be tufted by the changeable angle of deflection which the deflecting guide takes up with respect to the tufting axis of the tufting tool. Use of a comparatively complicated NC system and of a motor with which the guide jaws are driven and oriented with respect to each other in the case of the tufting tools known from the prior art can therefore be dispensed with. It should be pointed out that a change in the angle of deflection between the tufting axis and the deflecting guide by adjustment of the deflecting guide relative to the tufting axis can take place both during a tufting operation and also between two tufting operations.

It may be expedient here if end sides of the two guide jaws, which end sides face a brush body, are offset with respect to each other in the direction of the tufting axis in the tufting position of the tool head and/or of the guide jaws such that, in the tufting position, said end sides are at a comparable distance from the surface of the brush body. The two guide jaws can thereby take up a predefined and above all virtually identical distance from the brush to be equipped with clusters of bristles. It is thus possible to prevent the fastening means used for fastening the clusters of bristles in the respective bristle holes in the brush body, in particular the anchor plates, from springing out laterally or being offset laterally shortly before introduction into the brush body. This is possible since the pusher channel, through which the fastening means are supplied together with the clusters of bristles to the respective bristle hole, can continue, with the aid of the guide jaws positioned at a defined distance from the surface of the brush body or also bearing against said surface, into the bristle hole to be equipped without a gap relevant to the introduction of the clusters of bristles and of the fastening means remaining between the end sides of the guide jaws and an edge of the bristle hole. The clusters of bristles can thus be reliably introduced together with the fastening means into the respective bristle hole.

At this juncture, it should be pointed out that the two guide jaws in the tufting position can also directly contact the brush body to be equipped in order to configure the transfer or supply of the clusters of bristles and of the fastening means from the pusher channel into the bristle hole so as to be even more reliable.

The tufting tool according to the invention therefore makes it possible, firstly, reliably to introduce the clusters of bristles into the bristle holes in the brush body and to anchor same there and, secondly, to realize, in a manner which is as gentle as possible for the surface of the brush body, the guide jaw positioning necessary for said reliable introduction and anchoring of the clusters of bristles.

The deflecting guide can be designed here as a linear guide. Furthermore, it is possible for the angle of deflection between the deflecting guide and the tufting axis of the tufting tool to be an acute angle. The deflecting guide, in particular when the latter is designed as a linear guide, can therefore be oriented at an acute angle, preferably between 0° and 45°, with respect to the tufting axis of the tufting tool. Furthermore, it may be expedient if the angle of deflection can be changed, in particular can be changed between 0° and 45°, in order to be able to adapt the tufting tool to different tufting tasks or to different brush bodies or bristle holes to be tufted.

Depending on the angular offset of the deflecting guide with respect to the tufting axis of the tufting tool, the two guide jaws of the tool head, coupled to each other, can be displaced to different distances with respect to each other during the advance of the tool head into the tufting position in order finally, in the tufting position, to have a desired offset with respect to each other that is adapted to the surface of the brush body to be provided with clusters of bristles.

In the case of bristle holes which are introduced into the brush body at an angle of, for example, greater than 30° or in the case of contoured surfaces which have an inclination greater than 30°, in particular relative to the tufting axis of the tufting tool, it may be expedient if, in the receiving position of the tool head and/or of the guide jaws, the guide jaws are already offset with respect to each other in the direction of the tufting axis. In the receiving position of the tool head and/or of the guide jaws, one of the two guide jaws can therefore already protrude over the other guide jaw in the tufting direction. In the case of such a tufting tool, the two guide jaws therefore have an offset with respect to each other that is already adapted to that surface of the brush body which is to be equipped with clusters of bristles. This offset which is already present in the starting position can therefore be increased with the aid of the reversing lever and the deflecting guide during the advance of the tool head into the tufting position to an extent such that, in the tufting position, the guide jaws can be positioned in the desired manner adjacent to or baring against the brush body even if the latter has an inclination greater than 30°, in particular relative to the tufting axis of the tufting tool.

In order to be able to adapt the tufting tool to different angles at which the bristle holes can be introduced into the brush body or also to differently contoured brush bodies, it may also be expedient if, in order to change an angle between the deflecting guide and the tufting axis, the deflecting guide is arranged on an adjustment lever. Furthermore, it is possible, in order to change an angle between the deflecting guide and the tufting axis, for the deflecting guide and/or the adjustment lever to be pivotable about a pivot axis, in particular by means of a pivoting drive, and/or to be fixable in a selected pivot or angular position.

In order to be able to connect and/or couple the two guide jaws to each other by means of the reversing lever, it may be expedient if the reversing lever is of T-shaped or cross-shaped design. Furthermore, it is possible for the reversing lever, in particular if the latter is of T-shaped or cross-shaped design, to have a longitudinal limb and, for each of the two guide jaws, to have a transverse limb which protrudes from the longitudinal limb, in particular at a right angle, and is connected to the longitudinal limb for rotation therewith, with each of the transverse limbs acting in the use position on one of the two guide jaws.

If each of the two guide jaws has a receiving groove, in particular oriented at a right angle to the tufting axis, for the reversing lever and/or for a transverse limb, for example for one of the transverse limbs already described and assigned to the guide jaw, of the in particular T-shaped or cross-shaped reversing lever, in which receiving groove the reversing lever and/or the respective transverse limb engages in the use position with an end facing the guide jaw, it is possible to provide an in particular form-fitting connection between each of the two guide jaws and the reversing lever.

If the transverse limbs of the reversing lever each have, at the ends thereof facing the guide jaws in the use position, a deflecting roller which, in the use position, engages in a receiving groove, for example, the receiving groove which has already been described, of the guide jaw, which receiving groove is assigned to the respective transverse limb, friction between the reversing lever or the two transverse limbs and the two guide jaws during the advancing of the tool head and the coupled fine positioning of the two guide jaws with respect to each other, which fine positioning is adapted to an inclination of the brush body, can be reduced or avoided. It can thereby also be possible to avoid abrasion which is damaging to the production process and/or to the tufting tool.

It may be particularly favorable if the deflecting guide and/or the adjustment lever have/has two guide limbs, which are oriented parallel to each other, for the reversing lever, said guide limbs being at a constant distance from each other over the length thereof.

In a particularly advantageous embodiment of the tufting tool according to the invention, it can be provided that the deflecting lever, in particular on a longitudinal limb, for example the longitudinal limb already previously mentioned, of the reversing lever, preferably at a free lever end facing the deflecting guide, has a guide element, in particular a guide roller and/or a guide cam, which guide element in the use position engages in the deflecting guide and/or is positioned between guide limbs of the deflecting guide. It can thereby be possible for the reversing lever, which couples the two guide jaws to each other and which brings about and therefore makes possible the offset of the guide jaws with respect to each other during the advance of the tool head from the receiving position into the tufting position, to be guided exactly and reliably in the deflecting guide. The exact guidance of the reversing lever can contribute at least indirectly to a reliable supplying of a cluster of bristles into the pusher channel of the tufting tool since said guidance permits a precise setting and maintaining of a distance between one of the two guide jaws and at least part of the slider in the receiving position. This distance between one of the two guide jaws and the slider defines a cluster supply channel through which the clusters of bristles to be tufted can be supplied to the tufting tool. Said distance should be able to be set as exactly as possible and maintained so that neither the cluster of bristles nor a fastening means or an anchor plate is lost and/or is supplied imprecisely during a tufting operation, in particular during supply into the tufting tool.

It may be particularly advantageous if a longitudinal central axis of a guide element, for example the guide element already previously described, in particular a rotation axis of a or of the guide roller and/or a longitudinal central axes of a or of the guide cam, of the reversing lever, when the slider is displaced into the receiving position and/or when the guide jaws are displaced into the receiving position, is arranged coaxially with respect to a pivot axis, for example the pivot axis already mentioned previously, of the adjustment lever and/or of the deflecting guide and/or of the guide limbs, and/or is aligned with said pivot axis. It is thereby possible for the two guide jaws, if the slider and/or the tool head and/or the guide jaws are pushed back into the receiving position thereof, always to be able to be brought into the starting position thereof, whether with a predefined offset with respect to one another, or without an offset with respect to one another, irrespective of the angle or angle of deflection at which the deflecting guide is oriented with respect to the tufting axis of the tufting tool.

If, in a brush body, a plurality of holes or bristle holes are introduced into the brush body at the same angle, the deflecting guide can thereby remain oriented in a corresponding angular position with respect to the tufting axis of the tufting tool. A repositioning of the deflecting guide during the return stroke of the tufting tool can thus be avoided in this manner.

Furthermore, it is possible for an imaginary intersecting point of a longitudinal central axis of the reversing lever and of the longitudinal central axes of the transverse limbs of the reversing lever to lie on or above a longitudinal central axis of the pusher channel in the receiving position and in the tufting position of the tool head.

In one embodiment of the tufting tool according to the invention, it can be provided that a pivoting drive, for example the pivoting drive already mentioned previously, of the adjustment lever and/or of the deflecting guide has a belt drive, in particular a toothed belt drive, with which the adjustment lever and/or the deflecting guide is pivotable about the pivot axis of the adjustment lever and/or of the deflecting guide.

In another embodiment, it can be provided that the pivoting drive, in particular an output shaft of the pivoting drive, is connected directly to the adjustment lever and/or to the deflecting guide. In this case, the output shaft of the pivoting drive and the pivot axis of the adjustment lever and/or of the deflecting guide can then be arranged or oriented coaxially with respect to each other.

A uniform transmission of force to the two guide jaws of the tool head of the tufting tool is possible if the transverse limbs of the reversing lever are arranged symmetrically on the longitudinal lever. Furthermore, it is possible, in a pulled-back position of the slider and/or of the tool head and/or of the guide jaws, for a longitudinal central axis of the reversing lever to be arranged on or above a longitudinal central axis of the pusher channel.

In the case of a brush making machine of the type defined at the beginning, the abovementioned object is achieved by including one or more of the features of the invention, and in particular the tufting tool including one or more features for the tufting tool as summarized above and described in detail below and in the claims.

The brush making machine here can have a stand on which a circular arc divider, a material box with a bristle cluster store, a clamping device for a brush body to be tufted, a fastening means supply, in particular for the anchor material from which the anchor plates are cut, and the tufting tool as noted herein are arranged. The circular arc divider is designed here to remove a cluster of bristles from the bristle cluster store of the material box and to transfer same to the tufting tool. The tufting tool can then anchor the cluster of bristles together with a fastening means transferred to the tufting tool from the fastening means supply, in particular with an anchor plate, in a bristle hole in a brush body oriented obliquely with respect to the tufting axis of the tufting tool or a brush body surface oriented obliquely with respect to the tufting axis of the tufting tool.

Especially if the brush body is provided with bristle holes which are oriented at a different angle with respect to one another and/or with respect to the surface of the brush body, it may be expedient if a clamping device, for example the clamping device already mentioned previously, for the brush body to be tufted is arranged on a multi-axis coordinate table. In addition, the multi-axis coordinate table can be arranged pivotably, preferably by means of a rotation apparatus, in particular on the stand of the brush making machine.

In this manner, the brush body to be tufted can be brought, depending on how the bristle hole to be equipped with a cluster of bristles is oriented, into a desired position and orientation relative to the tufting axis of the tufting tool of the brush making machine with the aid of the multi-axis coordinate table and/or the rotation apparatus bearing the multi-axis coordinate table.

BRIEF DESCRIPTION OF THE DRAWINGS

An exemplary embodiment of the invention is described in more detail below with reference to the drawing, in which, in a partially greatly schematized illustration.

DETAILED DESCRIPTION OF THE PREFERRED EMBODIMENTS

Figure 1:
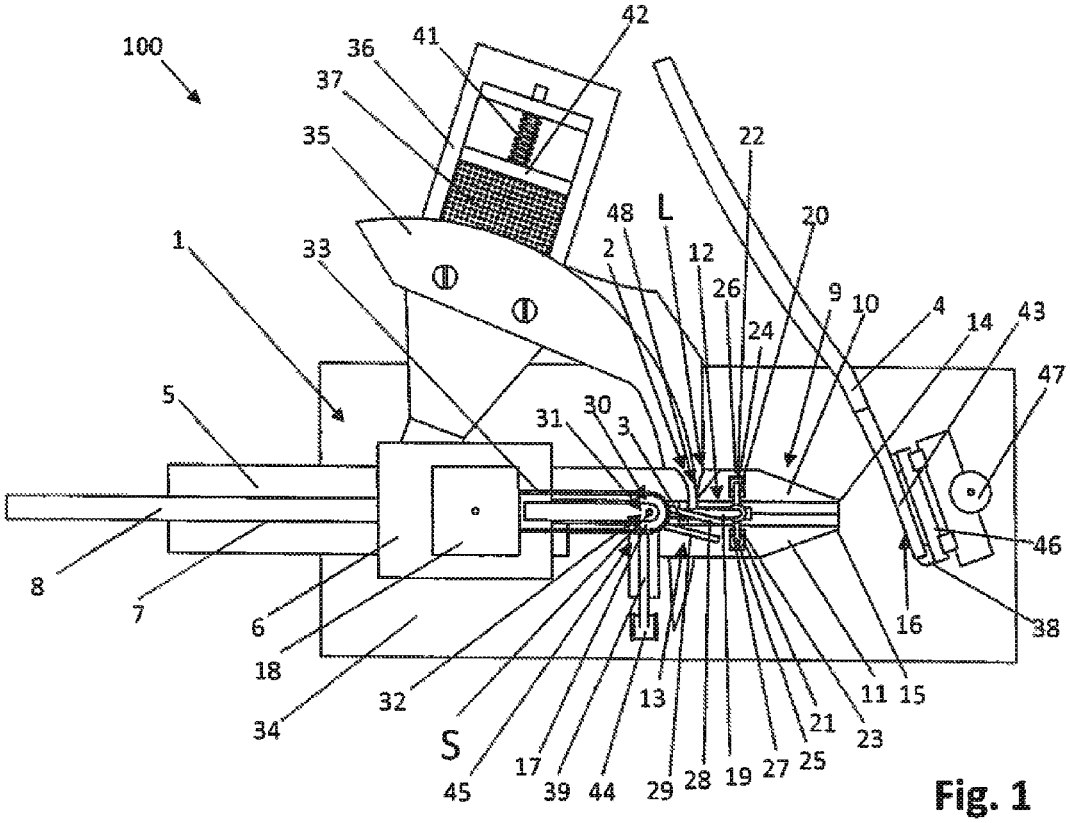
FIG. 1 shows a brush making machine according to the invention with a stand on which a material box with a bristle cluster store, a clamping device for a brush body to be tufted, a fastening means supply, a circular arc divider and the tufting tool according to the invention can be seen, wherein the tufting tool is illustrated in a receiving position relative to the circular arc divider.
Figure 2:
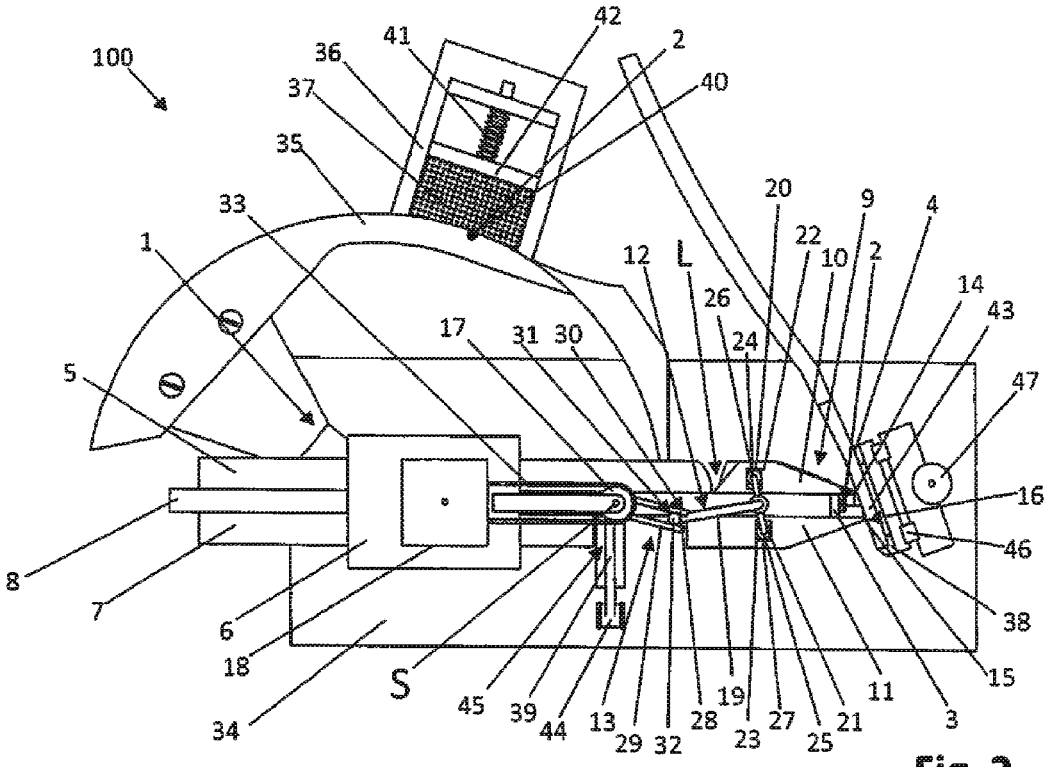
FIG. 2 shows the brush making machine illustrated in FIG. 1, wherein the tufting tool is advanced from the receiving position into a tufting position and the two guide jaws of the tool head of the tufting tool bear against a surface of a brush body held available in the clamping device of the brush making machine.

FIGS. 1 and 2 show a tufting tool, which is denoted in its entirety by 1, on a brush making machine denoted in its entirety by 100.

The tufting tool 1 is designed for tufting and fastening clusters of bristles 2 by fastening means, designed as anchor plates 3, in bristle holes 43 introduced into a contoured surface of a brush body or into bristle holes 43 introduced obliquely into a surface of a brush body 4.

FIGS. 1 and 2 show that the brush body 4 to be tufted is held ready for tufting on the brush making machine 100 at an angle different from 90°.

The tufting tool 1 has a slider 5 which is movable in a slider guide 6 along a tufting axis from a receiving position (illustrated in FIG. 1) for receiving a cluster of bristles 2 into a tufting position (illustrated in FIG. 2) and back again into the receiving position.

Furthermore, the tufting tool 1 is equipped with a pusher tongue 8, which is movable to and fro in a pusher channel 7 along the tufting axis of the tufting tool 1 relative to the slider 5, and with a tool head 9 which is displaceable along the tufting axis between a receiving position and a tufting position.

The tool head 9 has a pair of guide jaws 10 and 11 for the pusher tongue 8, the guide jaws 10, 11 being displaceable relative to each other during the advance of the tool head 9 from the receiving position into the tufting position in order to orient the guide jaws 10 and 11 in a manner adapted to the inclination of the brush body 4 and of the bristle holes 43.

In order to be able to orient the two guide jaws 10, 11 in a desired manner relative to each other and adapted to the inclination of the brush body 4, which is to be provided with clusters of bristles 2, during the displacement of the tool head 9, the tufting tool 1 has a reversing lever 12 which is connected to the tool head 9 and a deflecting guide 13 for the reversing lever 12, which deflecting guide is arranged at an angle of deflection with respect to the tufting axis of the tufting tool. The two guide jaws 10 and 11 here are coupled to each other via the reversing lever 12 in such a manner and the reversing lever 12 is guided in the deflecting guide 13 thereof in such a manner that an adjustment of the tool head 9 into the tufting position is connected to an advance of the one guide jaw 10 in the tufting direction and to a retraction of the other guide jaw 11 counter to the tufting direction. The deflecting guide 13 here is adjustable relative to the tufting axis in order to change the angle of deflection between the tufting axis of the tufting tool 1 and the deflecting guide 13, that is, the angle of deflection is changeable and therefore the tufting tool 1 is adaptable to different brush bodies to be tufted and to the geometries thereof.

The adjustment of the deflecting guide 13 relative to the tufting axis of the tufting tool 1 can take place during a tufting operation or else also between two tufting operations depending on requirements.

In the tufting position, illustrated in FIG. 2, of the tufting tool 1 or of the tool head 9, end sides 14 and 15 of the two guide jaws 10 and 11, which end sides face the brush body 4, have an offset with respect to each other in the direction of the tufting axis in the tufting position of the tool head 9 or of the guide jaws 10, 11, and therefore, in the tufting position, said end sides are at a comparable distance from the surface 16 of the brush body 4.

In the exemplary embodiment, illustrated in FIG. 2, of the tufting tool, in the tufting position, the two end sides 14 and 15 of the two guide jaws 10 and 11 bear against the surface 16 of the brush body 4 or are at a negligibly small distance which does not adversely affect a reliable transportation of the clusters of bristles 2 together with the anchor plates 3.

A movement of the guide jaws 10, 11 into the tufting position thereof is therefore associated with an adjustment of the one guide jaw 10 in the tufting direction and an adjustment back of the other guide jaw 11 counter to the tufting direction.

As the two figures show, the deflecting guide 13 is designed as a linear guide and is oriented at an acute angle with respect to the tufting axis of the tufting tool. In the exemplary embodiment of the tufting tool illustrated in the figures, the angle or angle of deflection between the deflecting guide 13 and the tufting axis of the tufting tool 1 is approximately 30°, but can be freely set at least within an angular range of between 0° and 45°.

In an exemplary embodiment of the tufting tool 1 not illustrated in the figures, in the receiving position of the tool head 9 and/or of the guide jaws 10, 11, the guide jaws 10 and 11 are already offset with respect to each other in the direction of the tufting axis. That is to say, in the receiving position of the tool head 9 and/or of the guide jaws 10, 11, one of the two guide jaws 10, 11 already protrudes over the other guide jaw 11 in the tufting direction.

This is favorable if surfaces 16 of brush bodies 4 are intended to be tufted with clusters of bristles 2 which are held ready on the or for the tufting tool 1 at an angle of greater than 30° relative to the tufting axis.

In order to change the angle of deflection between the deflecting guide 13 and the tufting axis, the deflecting guide 13 is arranged on an adjustment lever 17. In order to change the angle of deflection between the deflecting guide 13 and the tufting axis of the tufting tool 1, the deflecting guide 13 is pivotable together with the adjustment lever 17 about a pivot axis S by means of a pivoting drive 18 and is fixable in a selected pivot position or angular position relative to the tufting axis of the tufting tool 1.

The two figures show that the reversing lever 12 is of T-shaped or cross-shaped design and has a longitudinal limb 19 and, for each of the two guide jaws 10, 11, has a transverse limb 20 or 21 which protrudes at a right angle from the longitudinal limbs 19 and is connected to the longitudinal limb 19 for rotation therewith, with each of the two transverse limbs 20 and 21 acting in the use position on one of the two guide jaws 10, 11 such that the two guide jaws 10, 11 are coupled firstly to the reversing lever 12 and secondly to each other via the two transverse limbs 20 and 21 and, in interaction with the deflecting guide 13, are displaceable in a desired manner with respect to each other during the advance of the tool head 9 into the tufting position.

In addition, each of the two guide jaws 10, 11 is provided with a receiving groove 22 or 23, oriented at a right angle to the tufting axis of the tufting tool 1, for the reversing lever 12 and/or for a respective transverse limb 20, 21, assigned to the two guide jaws 10, 11, of the T-shaped reversing lever 12. The reversing lever 12 engages in said receiving grooves 22, 23 with an end 24 or 25, facing the guide jaw 10, 11, of in each case one of the two transverse limbs 20, 21 thereof, in order to produce a form-fitting connection between the respective guide jaw 10, 11 and the reversing lever 12 in the use position.

The transverse limbs 20 and 21 of the reversing lever 12 each have, at the ends 24 and 25 thereof facing the guide jaws 10, 11 in the use position, a deflecting roller 26, 27 which, in the use position, engages in a receiving groove 22, 23 of the guide jaw 10 or 11, which receiving groove is assigned to the respective transverse limb 20, 21.

The deflecting guide 13 is formed by two guide limbs 28 and 29 which are oriented parallel to each other and are at a constant distance from each other over the length thereof.

The reversing lever 12, at a free lever end 30 of the longitudinal limb 19, which lever end faces the deflecting guide 13, has a guide element 31 which, in the case of the exemplary embodiment of the tufting tool 1 that is illustrated in the figures, is designed as a guide roller 32. In the use position, said guide element 31 engages in the deflecting guide 13 and is positioned between the two guide limbs 28 and 29 of the deflecting guide 13.

The guide element 31 which is designed as a guide roller 32 can thereby roll on the two parallel guide limbs 28 and 29 and can thus transmit the movement of the reversing lever 12 via the longitudinal limb 19 and the two transverse limbs 20 and 21 to the guide jaws 10 and 11 assigned to the transverse limbs 20 and 21.

In an exemplary embodiment of the tufting tool 1 that is not illustrated in the figures, the guide element 31 is designed as a guide cam which can slide to and fro in the deflecting guide 13 between the two guide limbs 28 and 29.

FIG. 1 shows that, when the slider 5 is displaced into the receiving position and when the guide jaws 10, 11 are displaced into the receiving position, the guide roller 32 of the reversing lever 12 is arranged coaxially with respect to the pivot axis S of the adjustment lever 17 and of the deflecting guide 13 and of the guide limbs 28 and 29. This means that a rotation axis of the guide roller 32 of the reversing lever 12 is aligned with the pivot axis S of the adjustment lever 17, as a result of which the adjustment lever 17 can be guided particularly exactly in the deflecting guide 13.

Furthermore, an imaginary intersecting point of a longitudinal central axis of the reversing lever 12 and of the longitudinal central axes of the transverse limbs 20 and 21 of the reversing lever 12 lies on or above a longitudinal central axis of the pusher channel 7 in a receiving position and in a tufting position of the tool head 9 according to the two figures.

According to the two figures, the pivoting drive 18 of the adjustment lever 17 and/or of the deflecting guide 13 is equipped with a belt drive 33 which, in the present exemplary embodiment, is designed as a toothed belt drive. With said belt drive 33, the adjustment lever 17 and the deflecting guide 13 can be pivoted about the pivot axis S of the adjustment lever 17 and of the deflecting guide 13 in order to set a desired angle or angle of deflection between the deflecting guide 13 and the tufting axis of the tufting tool 1.

In an exemplary embodiment of the tufting tool 1, that is not illustrated in the figures, the pivoting drive 18 is connected directly to the adjustment lever 17 and/or to the deflecting guide 13 via an output shaft of the pivoting drive 18. In this case, the output shaft of the pivoting drive 18 and the pivot axis S of the adjustment lever 17 and/or of the deflecting guide 13 are arranged coaxially with respect to each other, i.e. rotate about the same axis.

The two figures show that the transverse limbs 20 and 21 of the reversing lever 12 are arranged symmetrically on the longitudinal lever 19, and that, in a pulled-back position of the slider 5 and of the tool head 9 and of the two guide jaws 10 and 11, a longitudinal central axis of the reversing lever 12 is arranged on or above a longitudinal central axis of the pusher channel 7.

The brush making machine denoted in its entirety by 100 has the tufting tool 1.

The brush making machine 100 has a stand 34 on which a circular arc divider 35, a material box 36 with a bristle cluster store 37, a clamping device 38 for a brush body 4 to be tufted, a fastening means supply 39 and the tufting tool 1 are arranged.

The circular arc divider 35 has a circular arc notch 40 with which said circular arc divider is guided along a circular arc past a lower side of the material box 36, removes a cluster of bristles 2 from the bristle cluster store 37, which is pressed against the circular arc divider 35 by means of a compression spring 41 and a pressing mechanism 42, and transfers said cluster of bristles 2 to the tufting tool 1.

The tufting tool 1 then anchors the cluster of bristles 2 together with a fastening means, which is transferred from the fastening means supply 39 to the tufting tool 1 and in the present case is an anchor plate 3, in a bristle hole 43 in the brush body 4 in a manner known per se by the pusher tongue 8.

It should be pointed out at this juncture that a distance L between the upper guide jaw 10 of the tool head 9 and of the slider 5 has to be exact during the introduction of a cluster of bristles 2 by the circular arc divider 35 until the cluster of bristles 2 is removed from the circular arc notch 40 with the aid of the anchor plate 3, which is pushed through the pusher channel 7 by the pusher tongue 8. If this distance L is too small, then clusters of bristles 2 are not correctly introduced by the circular arc divider 35. If the distance L is too large, the anchor plate 3 may become lost.

The previously described exact guidance of the reversing lever 12, which guidance is made possible by the aligned and coaxial arrangement (apparent in particular from FIG. 1) of the rotation axis of the guide element 31, which is designed as a guide roller 32, with respect to the pivot axis S of the adjustment lever 17, contributes to a reliable supply of a cluster of bristles 2 into the pusher channel 7 of the tufting tool 1 by said guidance permitting a precise setting and maintaining of the distance, denoted by L, between the upper of the two guide jaws 10 and 11 and at least a part of the slider 5 in the receiving position. In the receiving position of the slider 5 and of the tool head 9 and of the two guide jaws 10, 11, this distance L between the upper of the two guide jaws 10, 11 in the figures and the slider 5 namely defines, according to FIG. 1, a cluster supply channel 48 through which the clusters of bristles 2 to be tufted can be supplied to the tufting tool 1.

The fastening means supply 39 comprises a reel 44 on which an anchor wire is coiled, and a knife 45 with which individual anchor plates 3 can be cut off from the anchor wire supplied to the tufting tool 1 via the fastening means supply 39.

As the two figures show, a clamping device 38 for the brush body 4 to be tufted is arranged on a multi-axis coordinate table 46 which is arranged pivotably on the stand 34 of the brush making machine 100 by means of a rotation apparatus 47. With the aid of the multi-axis coordinate table 46 and the rotation apparatus 47, the brush body 4 which is held ready in the clamping apparatus 38 for tufting can be held ready in a manner oriented at virtually any angle with respect to the tufting axis of the tufting tool 1. The brush body 4 here is always oriented in such a manner that a longitudinal central axis of a bristle hole 43 or of a bristle hole bore is located in a rectilinear continuation of the tufting axis of the tufting tool 1 or with respect to the longitudinal central axis of the pusher channel 7.

According to FIG. 2, in the tufting position, the two guide jaws 10 and 11 bear against the brush body 4 to be equipped with clusters of bristles 2, which is favorable since anchor plates 3 and clusters of bristles 2 conveyed by the pusher tongue 8 through the pusher channel 7 cannot drop out laterally during the transfer from the pusher channel 8 into the respective bristle hole 43 but rather can be reliably inserted into the bristle hole 43, which is to be provided with the cluster of bristles 2 and the anchor plate 3, in the brush body 4 and can be anchored there.

The tufting tool 1 is designed for tufting and fastening clusters of bristles 2, in particular by means of anchor plates 3, in bristles holes 43 introduced into a contoured surface of the brush body 4 and/or into bristle holes 43 introduced obliquely into the surface of a brush body 4, the tufting tool 1 having the slider 5 which is movable in the slider guide 6 along a tufting axis from a receiving position for receiving the cluster of bristles 2 into a tufting position and back again into the receiving position. Furthermore, the tufting tool 1 has the pusher tongue 8 which is movable to and fro in the pusher channel 7 along the tufting axis of the tufting tool 1 relative to the slider 5 and the tool head 9 which is displaceable along the tufting axis between a receiving position and a tufting position. Said tool head 9 is equipped with the two guide jaws 10 and 11 by means of which the pusher tongue 8 pushes the cluster of bristles 2 together with an anchor plate 3 into a bristle hole 43 to be provided with the cluster of bristles 2.

During the advance of the tool head 9 from the receiving position into the tufting position, the two guide jaws 10 and 11 are displaceable relative to each other in order to adapt the two guide jaws 10, 11 in a manner corresponding to the inclination of a surface 16 of the brush body 4 and/or of the bristle holes 43. In order to be able to bring about this displacement of the two guide jaws 10 and 11 with respect to each other, the tufting tool 1 has the reversing lever 12, which is connected to the tool head 9, and the deflecting guide 13 for the reversing lever 12, wherein the two guide jaws 10 and 11 are coupled to each other via the reversing lever 12 in such a manner and the reversing lever 12 is guided in the deflecting guide 13 thereof in such a manner that an adjustment of the tool head 9 into the tufting position is connected to an advance of the one guide jaw 10 in the tufting direction and to a retraction of the other guide jaw 11 counter to the tufting direction, with the deflecting guide 13 being adjustable relative to the tufting axis in order to change the angle of deflection between the tufting axis of the tufting tool 1 and the deflecting guide 13.

The invention claimed is:

1. A tufting tool (1) for tufting and fastening clusters of bristles (2) in bristle holes (43) which are introduced into a contoured surface of a brush body (4) and/or obliquely into a surface of a brush body (4), the tufting tool (1) comprising a slider (5) which is movable in a slider guide (6) along a tufting axis from a receiving position for receiving a cluster of bristles (2) into a tufting position and back again into the receiving position, a pusher tongue (8) which is movable to and fro relative to the slider (5) along the tufting axis of the tufting tool (1) in a pusher channel (7), and a tool head (9) which is displaceable along the tufting axis between a receiving position and a tufting position and has a pair of guide jaws (10, 11) for the pusher tongue (8), the guide jaws (10, 11) being displaceable relative to each other during adjustment of the tool head (9) from the receiving position into the tufting position, wherein the tufting tool (1) has a reversing lever (12) which is connected to the tool head (9) and a deflecting guide (13) for the reversing lever (12), said deflecting guide is arranged at an angle of deflection with respect to the tufting axis of the tufting tool, and the two guide jaws (10, 11) are coupled to each other via the reversing lever (12) in such a manner and the reversing lever (12) is guided in the deflecting guide (13) thereof in such a manner that an adjustment of the tool head (9) into the tufting position is connected to an advance of the one guide jaw (10) in the tufting direction and to a retraction of the other guide jaw (11) counter to the tufting direction, with the deflecting guide (13) being adjustable relative to the tufting axis in order to change an angle of deflection between the tufting axis of the tufting tool (1) and the deflecting guide (13).

2. The tufting tool (1) as claimed in claim 1, wherein end sides (14, 15) of the two guide jaws (10, 11) which face a brush body (4), are offset with respect to each other in a direction of at least one of the tufting axis in the tufting position of the tool head (9) or of the guide jaws (10, 11) such that, in the tufting position, said end sides are at a comparable distance from a surface (16) of the brush body (4).

3. The tufting tool (1) as claimed in claim 1, wherein the deflecting guide (13) is a linear guide, or wherein the angle of deflection between the deflecting guide (13) and the tufting axis of the tufting tool is an acute angle.

4. The tufting tool (1) as claimed in claim 1, wherein, in a receiving position of at least one of the tool head (9) or of the guide jaws (10, 11), the guide jaws (10, 11) are offset with respect to each other in a direction of the tufting axis.

5. The tufting tool (1) as claimed claim 1, wherein, in order to change the angle of deflection between the deflecting guide (13) and the tufting axis, the deflecting guide (13) is arranged on an adjustment lever (17).

6. The tufting tool (1) as claimed in claim 5, wherein at least one of the deflecting guide (13) or the adjustment lever (17) has two guide limbs (28, 29), which are oriented parallel to each other, for the reversing lever (12), said guide limbs being at a constant distance from each other over a length thereof.

7. The tufting tool (1) as claimed in claim 5, wherein a pivoting drive (18) of the adjustment lever (17) or of the deflecting guide (13) has a belt drive (33) with which at least one of the adjustment lever (17) or the deflecting guide (13) is pivotable about a pivot axis (S) of the adjustment lever (17) or of the deflecting guide (13), or wherein the pivoting drive (18) is connected directly to at least one of the adjustment lever (17) or to the deflecting guide (13).

8. The tufting tool (1) as claimed in claim 1, wherein the reversing lever (12) is of T-shaped or cross-shaped design, or has a longitudinal limb (19) and, for each of the two guide jaws (10, 11), has a transverse limb (20, 21) which protrudes from the longitudinal limb (19), and is connected to the longitudinal limb (19) for rotation therewith, with the transverse limb (20, 21) acting in the use position on one of the two guide jaws (10, 11).

9. The tufting tool (1) as claimed in claim 8, wherein the transverse limbs (20, 21) of the reversing lever (12) are arranged symmetrically on the longitudinal lever (19), or wherein, in a pulled-back position of at least one of the slider (5), the tool head (9), or the guide jaws (10, 11), a longitudinal central axis of the reversing lever (12) is arranged on or above a longitudinal central axis of the pusher channel (7).

10. The tufting tool (1) as claimed in claim 1, wherein each of the guide jaws (10, 11) has a receiving groove (22, 23) for at least one of the reversing lever (12) or for a transverse limb (20, 21), assigned to the guide jaws (10, 11), of the reversing lever (12), and the at least one of the reversing lever (12) or the transverse limb (20, 21) engages in the receiving groove (22, 23) with an end (24, 25) facing the guide jaws (10, 11), in order to produce a form-fitting connection between the guide jaws (10, 11) and the reversing lever (12) in the use position.

11. The tufting tool (1) as claimed in claim 10, wherein the transverse limbs (21, 22) of the reversing lever (12) each have, at ends (24, 25) thereof facing the guide jaws (10, 11) in the use position, a deflecting roller (26, 27) which, in the use position, engages in a or the receiving groove (22, 23) of the guide jaw (10, 11), and said receiving groove is assigned to the respective transverse limb (20, 21).

12. The tufting tool (1) as claimed claim 1, wherein the reversing lever (12) at a free lever end (30) facing the deflecting guide (13), has a guide element (31) which in the use position at least one of engages in the deflecting guide (13) or is positioned between guide limbs (28, 29) of the deflecting guide (13).

13. The tufting tool (1) as claimed in claim 12, wherein a longitudinal central axis of the guide element (31), when at least one of the slider (5) or the guide jaws (10, 11) are displaced into the receiving position, is arranged coaxially with respect to a pivot axis (S) of the adjustment lever (12).

14. The tufting tool (1) as claimed in claim 12, wherein at least one of the deflecting guide (13) or the guide limbs (28, 29) is aligned with said pivot axis, or wherein an imaginary intersecting point of a longitudinal central axis of the deflecting lever (12) and of the longitudinal central axis of the transverse limbs (20, 21) of the deflecting lever (12) lies on or above a longitudinal central axis of the pusher channel (7) in the receiving position and in the tufting position of the tool head (9).

15. The tufting tool (1) as claimed in claim 1, wherein the angle of deflection is changeable between 0° and 45°.

16. The tufting tool (1) as claimed in claim 1, wherein, in a receiving position of at least one of the tool head (9) or of the guide jaws (10, 11), one of the two guide jaws (10, 11) protrudes over the other guide jaw (10, 11) in the tufting direction.

17. The tufting tool (1) as claimed in claim 1, wherein, in order to change an angle of deflection between the deflecting guide (13) and the tufting axis, at least one of the deflecting guide (13) or the adjustment lever (17) is pivotable about a pivot axis (5), and is fixable in a selected pivot position or angular position.

18. A brush making machine (100) with a tufting tool (1), wherein the tufting tool (1) is a tufting tool (1) as claimed in claim 1.

19. The brush making machine (100) as claimed in claim 18, wherein the brush making machine (100) has a stand (34) on which a circular arc divider (35), a material box (36) with a bristle cluster store (37), a clamping device (38) for a brush body (4) to be tufted, a fastening element supply (39) and the tufting tool (1) are arranged, the circular arc divider (35) being designed to remove a cluster of bristles (2) from the bristle cluster store (37) of the material box (36) and to transfer said cluster of bristles (2) to the tufting tool (1) which anchors the cluster of bristles (2) together with the fastening element (3) transferred to the tufting tool (1) from the fastening element supply (39) in a bristle hole (43) in a brush body (4).

20. The brush making machine (100) as claimed in claim 18 or 19, wherein a or the clamping device (38) for the brush body (4) to be tufted is arranged on a multi-axis coordinate table (46), the multi-axis coordinate table (46) being arranged pivotably, preferably by means of a rotation apparatus (47), in particular on the stand (34) of the brush making machine (100).

* * * * *